US005743453A

United States Patent [19]

Chuang

[11] Patent Number: 5,743,453

[45] Date of Patent: Apr. 28, 1998

[54] MAGAZINE FOR A STAPLE TACKER

[75] Inventor: Hung-Ming Chuang, Taichung, Taiwan

[73] Assignee: Newco Pneumatic Corp., Taichung, Taiwan

[21] Appl. No.: 785,772

[22] Filed: Jan. 21, 1997

[51] Int. Cl.[6] ..... B25C 1/04

[52] U.S. Cl. ..... 227/109; 227/120

[58] Field of Search ..... 227/120, 109, 227/130, 8

[56] References Cited

U.S. PATENT DOCUMENTS

| | | | |
|---|---|---|---|
| 4,524,896 | 6/1985 | Morrell, Jr. | 227/109 |
| 4,815,647 | 3/1989 | Chou | 227/109 |
| 5,522,533 | 6/1996 | Mukoyama et al. | 227/109 |
| 5,588,577 | 12/1996 | Chen | 227/120 |
| 5,632,431 | 5/1997 | Lin | 227/120 |

*Primary Examiner*—Scott A. Smith
*Attorney, Agent, or Firm*—Charles E. Baxley, Esq.

[57] ABSTRACT

A magazine for a staple tacker includes a base portion having a cover slidably disposed thereto, the base portion having a recessed area defined in a bottom thereof and six notches being defined each of the first end wall and second end wall thereof. At least two resilient elements disposed on the recessed area and each of which has a plurality of flexible ribs extending laterally from two opposite sides thereof such that six positioning plates are mounted across between the notches between the first end wall and the second end wall to depress the flexible ribs with a pin movably extending through a slot defined in each of the positioning plates. A control member having a receiving section and a pressing section extends from the second end wall and is pushed by an end cap of the cover when the cover is slidably mounted to the base portion such that the pressing section pressing the pin is moved away from the pin to allow the pin to be raised toward the cover within the receiving section by the flexible ribs. Staples are positioned between the bottom and the positioning plates and the staples has one end thereof contacting against an adjacent positioning plate which is raised toward the cover by the flexible ribs.

3 Claims, 7 Drawing Sheets

MAGAZINE FOR A STAPLE TACKER

BACKGROUND OF THE INVENTION

1. Field of the Invention

The present invention relates to a magazine for a staple racket and more particularly, to a magazine having a plurality of positioning plates and a control member so as to position staplers with different sizes in the magazine.

2. Brief Description of the Prior Art

A staple tacker is a handy machine for fastening wooden articles or the like together and generally has a body connected to a pneumatic source and a magazine for storing staples therein is detachably disposed to the body of the staple tacker. Staples can be ejected from a nose portion of the body and penetrate the wooden articles to be combined together. FIGS. 1 and 2 show a staple tacker 90 having a magazine 91 disposed thereto which has staples 92 received therein so as to be ejected from a nose portion 93 of the staple tacker 90. The magazine 91 includes a base portion 912 and a cover 912 which is slidably disposed to the base portion 912 which has a flange 94 extending upwardly from a bottom surface thereof so as to position the staples 912. However, such a magazine can only receive one size of staples therein such that if a user (not shown) needs to use another size of staples, he/she has to change another magazines. Therefore, the user carries many magazines with him/her and this is inconvenient in a working place. Furthermore, staples 92 in the magazine 91 could be moved from the flange 94 by a force of the pneumatic source such that the staple tacker 90 can be normally used again until the user re-arranges a position of the staples 92.

The present invention intends to provide an improved magazine for a staple tacker and which has a plurality of positioning plates and a control member disposed in the magazine such that staples with different sizes can be positioned by operating the control member so as to mitigate and/or obviate the above-mentioned problems.

SUMMARY OF THE INVENTION

The present invention provides a magazine for a staple tacker and which comprises a base portion having a bottom with two side walls, each of the side walls having a groove defined in an inner surface thereof so that a cover is slidably received therein. The bottom has a recessed area defined therein by a first end wall and a second end wall, each of the first end wall and the second end wall having a plurality of notches defined therein. A passage is defined in the second end wall and communicates with the recessed area.

At least two resilient elements disposed on the bottom and each of the resilient elements has a plurality of flexible ribs extending laterally from two opposite sides thereof.

A plurality of positioning plates are mounted between the notches of the first and second end walls, each of the positioning plates contacting and depressing the flexible ribs corresponding thereto and having a slot defined transversely therein for a pin to be movably extended therethrough.

A control member extends through the passage and has a receiving section and a pressing section which extends from the receiving section. The receiving portion extends inclinedly from an axis of the control member and the pressing section extends toward a direction opposite to that of the receiving section.

A cover has two side flanges to be slidably received in the grooves of the base portion, the cover having an end cap disposed to an end thereof so as to push the control member extending from the second end wall of the base portion toward the first end wall of the base portion wherein the receiving section is moved to a position of the pin when the control member is pushed by the end cap such that the positioning plates are raised toward the cover by the flexible ribs of the resilient elements.

It is an object of the present invention to provide a magazine for a staple tacker and which is suitable for receiving staples with different sizes.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
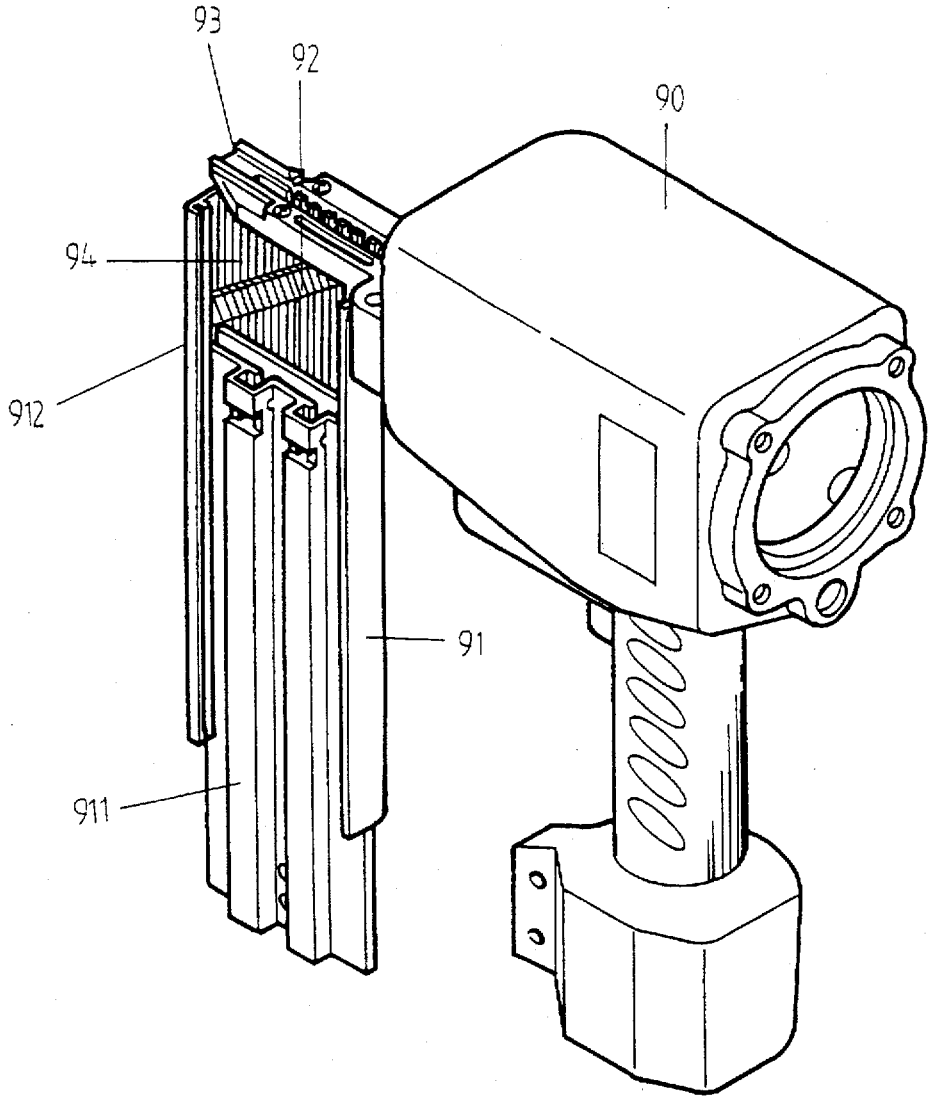
FIG. 1 PRIOR ART
FIG. 1 is a perspective view of a staple tacker with a conventional magazine disposed thereto.
Figure 2:
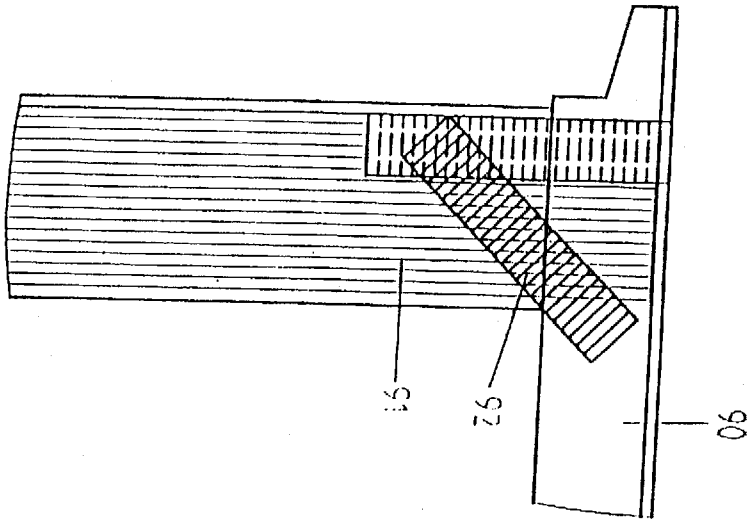
FIG. 2 PRIOR ART
FIG. 2 is an illustrative view to show staples in the conventional magazine are moved from an original position of the staples.
Figure 3:
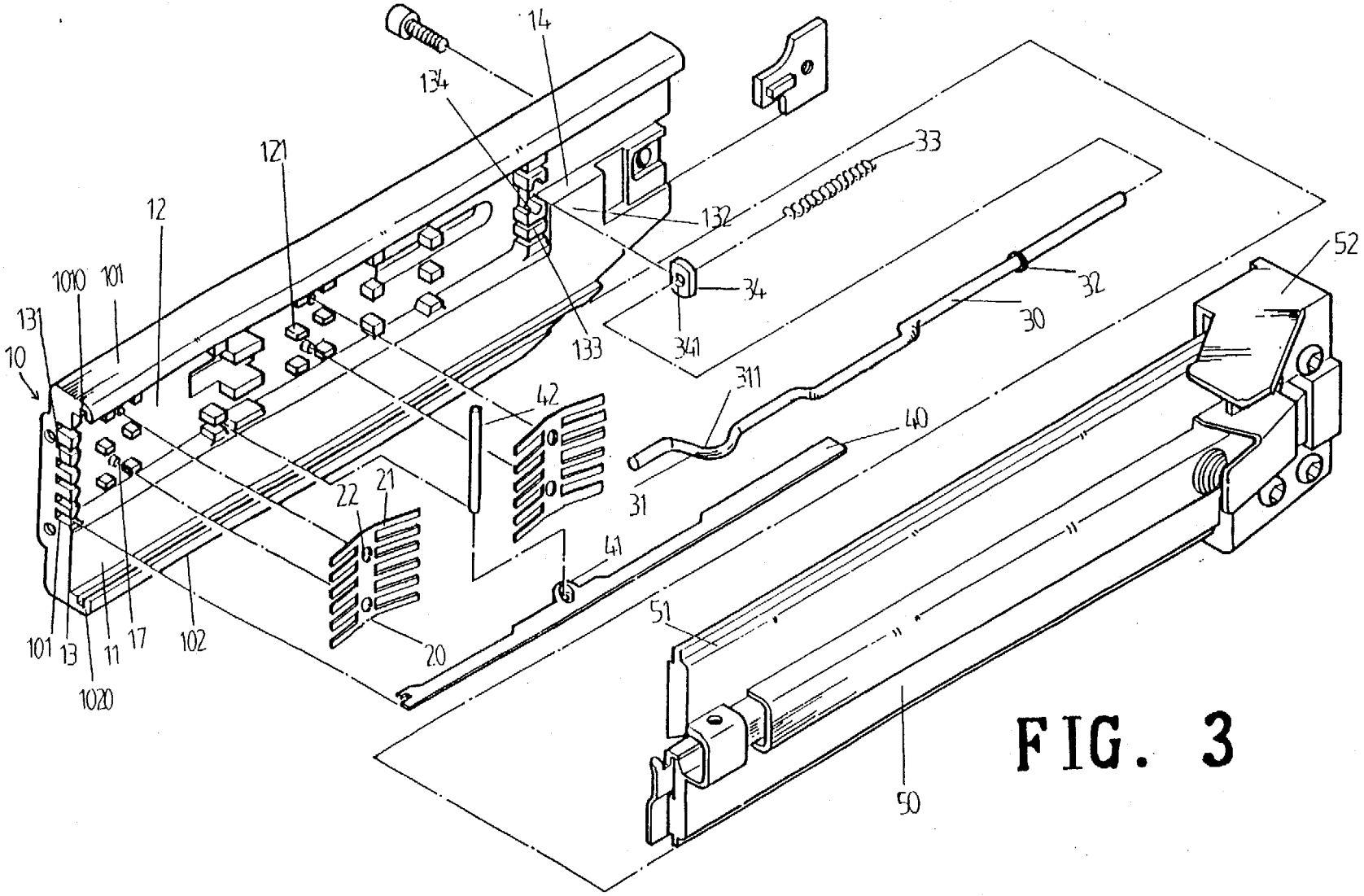
FIG. 3 is an exploded view of a magazine in accordance with the present invention.
Figure 4:
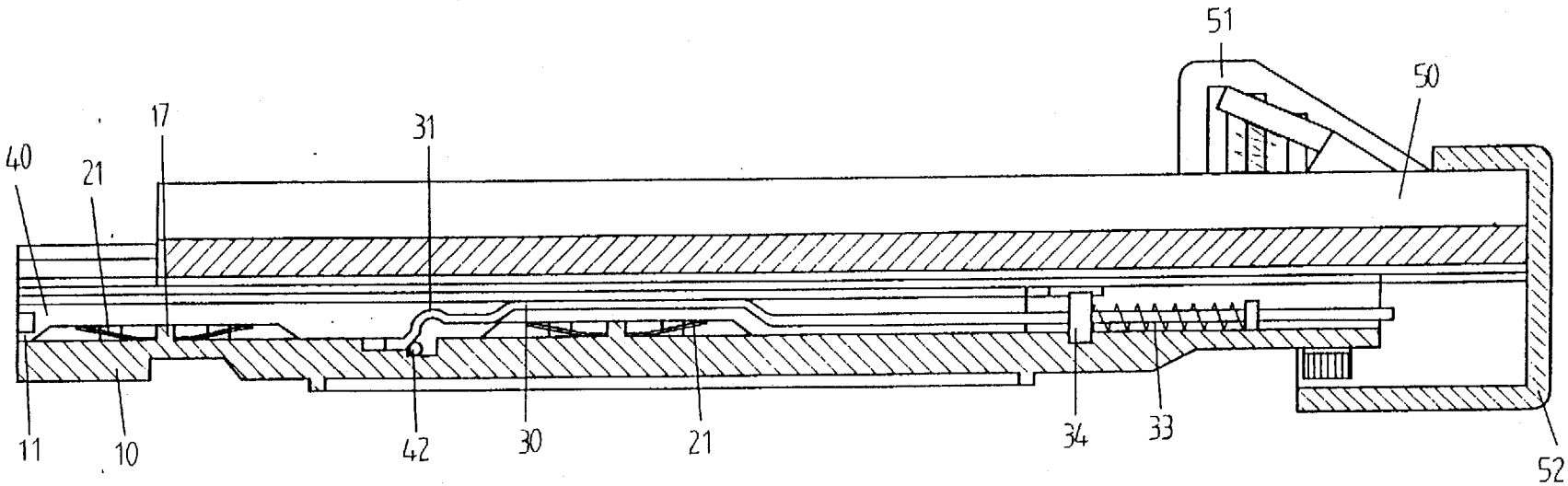
FIG. 4 is a side elevational view, partly in section, of the magazine wherein the cover is not yet mounted to the base portion completely.

Referring to the drawings and initially to FIGS. 3 and 4, a magazine in accordance with the present invention generally includes a base portion 10 having a bottom 11 with two side walls 101, 102 extending laterally from two opposite sides of the bottom 11. Each of the side walls 101, 102 has a groove 1010, 1020 defined in an inner surface thereof. The bottom 11 has a recessed area 12 defined therein by a first end wall 13 and a second end wall 132. The first end wall 13 has a plurality of first notches 131 defined therein and the second end wall 132 having a plurality of second notches 133 defined therein. A passage 14 is defined in the second end wall 132 and communicates with the recessed area 12. The second end wall 132 has a transverse slot 134 defined therein so as to receive a stop 34 therein which has a central hole 341 defined therein. The recessed area 12 has a plurality of guide blocks 121 and four protrusions 17 respectively extending therefrom.

At least two resilient elements 20 are disposed on the recessed area 12 and each of the resilient elements 20 has a plurality of flexible ribs 21 extending laterally from two opposite sides thereof. Each of the resilient elements 20 has two holes 22 defined therein so as to mount on the protrusions 17 of the recessed area 12.

A plurality of positioning plates 40 are mounted between the first notches 131 and the second notches 133 and are guided by the guide blocks 121. Each of the positioning plates 40 has a slot 41 defined transversely therein for a pin 42 to be movably extended therethrough and each of the positioning plates 40 contacts the flexible ribs 21 corresponding thereto of the two resilient elements 20.

A control member 30 extends through the passage 14 and the central hole 341 of the stop 34. The control member 30 has a receiving section 311 and a pressing section 31 which extends from the receiving section 311. The receiving portion 311 extends inclinedly from an axis of the control member 30 and the pressing section 31 extends toward a direction opposite to that of the receiving section 311. The control member 30 has an annular flange 32 extending radially therefrom and a spring 33 is mounted to the control member 30 between the annular flange 32 and the stop 34.

Figure 5:
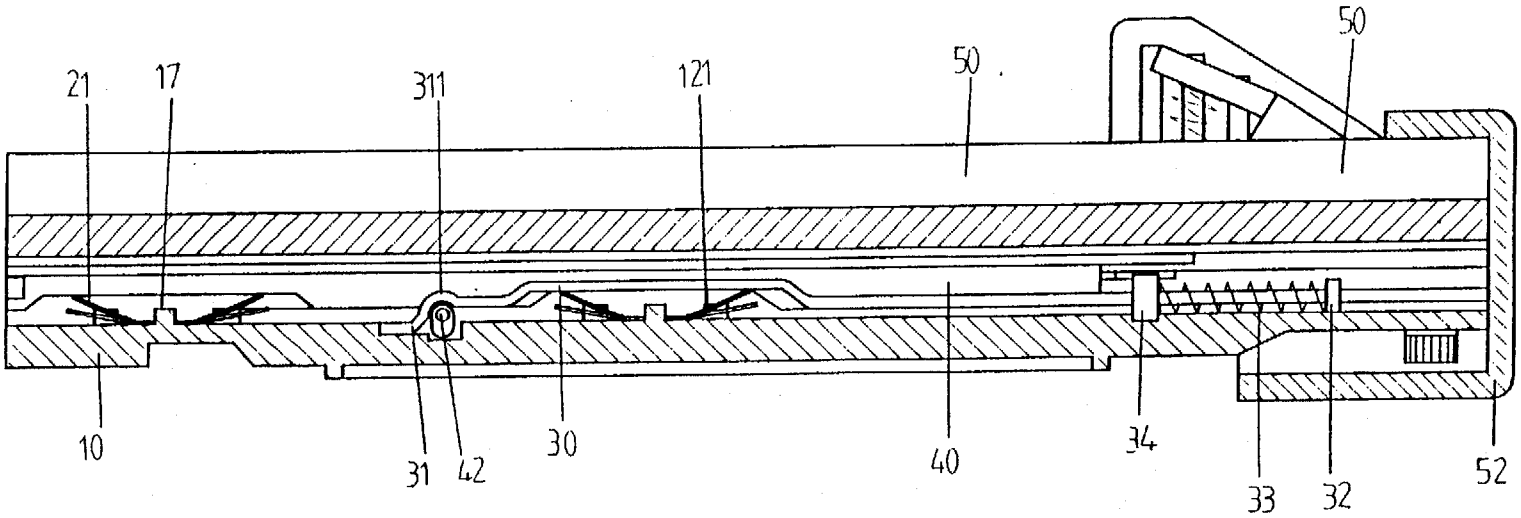
FIG. 5 is a side elevational view, partly in section, of the magazine wherein the cover is completely mounted to the base portion to push the control member toward a first end wall of the base portion.
Figure 6:
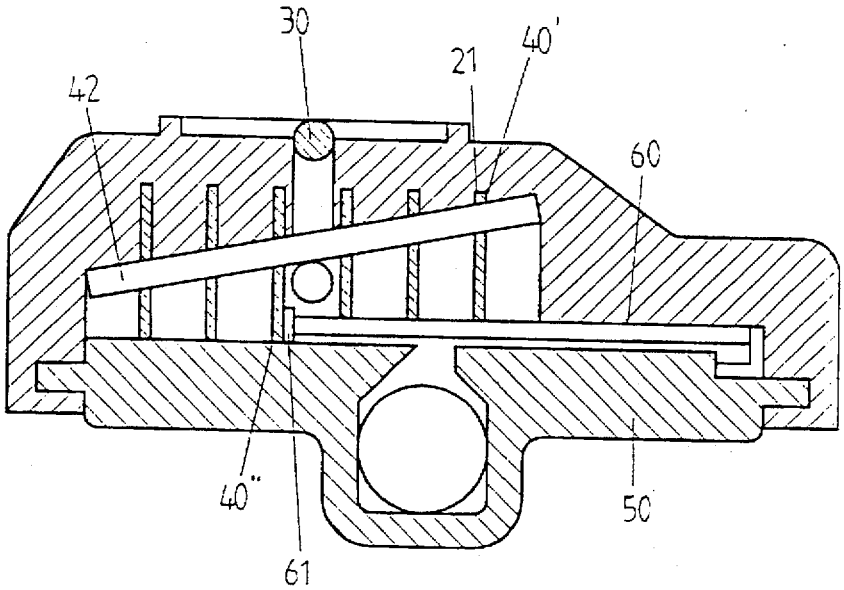
FIG. 6 is an end elevational view to show the pin is raised toward the cover inclinedly by flexible ribs when the control member is pushed by the end cap of the cover.

A cover 50 has two side flanges 51 extending from two opposite sides thereof so as to be slidably received in the grooves 1010, 1020 of the base portion 10. Further referring to FIGS. 5 and 6, staples 60 are inserted in the magazine and are disposed between three positioning plates 40' and the cover 50 and the cover 50 has an end cap 52 disposed to an end thereof. When the cover 50 is not yet completely mounted to the base portion 10, the pin 42 is pressed by the pressing section 31 of the control member 30 as shown in FIG. 4. When the cover 50 is completely mounted to the base portion 10, the end cap 52 pushes the control member 30 extending from the second end wall 132 of the base portion 10 toward the first end wall 13 and the pressing section 31 is therefore moved away from the pin 42 and the receiving section 311 is moved to a position of the pin 42. The pin 42 is then raised toward the cover 50 by flexible ribs 21 of the resilient elements 20 wherein because the staples 60 are disposed between the cover 50 and the positioning plates 40' so that the positioning plates 40' will not be raised and the positioning plats 40" are raised toward the cover 50 such that heads 61 of the staples 60 contact against an adjacent positioning plate 40" to position the staples 60.

Accordingly, the magazine in accordance with the present invention can be used to receive staples 60 with different sizes and heads 61 of the staples 60 contact one of the positioning plates 40.

Figure 7:
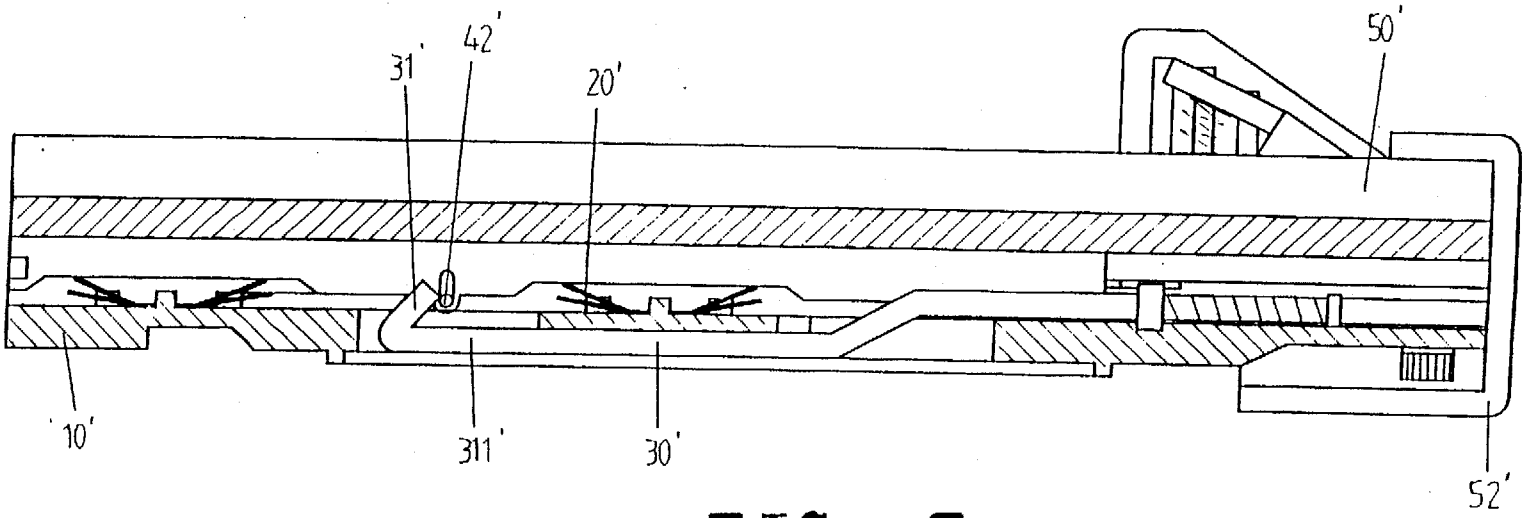
FIG. 7 is a side etevational view, partly in section, of another embodiment of the magazine wherein the cover is completely mounted to the base portion.

FIG. 7 shows another embodiment of the control member 30 which has a receiving section 311' and a pressing section 31' extending from a free end of the receiving section 311' such that when the cover 50' is not yet completely mounted to the base portion 10', the pin 42' is pressed by the pressing section 31' and when the control section 30' is pushed by the end cap 52', the control member 30' is pushed toward left and the pin 42' is then be raised toward the cover 50' by resilient elements 20'.

Although the invention has been explained in relation to its preferred embodiment, it is to be understood that many other possible modifications and variations can be made without departing from the spirit and scope of the invention as hereinafter claimed.

What is claimed is:

1. A magazine for a staple tacker and comprising:

a base portion having a bottom with two side walls extending laterally from two opposite sides of the bottom, each of said side walls having a groove defined in an inner surface thereof, said bottom having a recessed area defined therein by a first end wall and a second end wall, said first end wall and said second end wall having a plurality of notches defined therein, a passage defined in said second end wall and communicating with said recessed area;

at least two resilient elements disposed on said recessed area and each of said resilient elements having a plurality of flexible ribs extending laterally from two opposite sides thereof;

a plurality of positioning plates mounted between said notches of said first end wall and said second end wall, each of said positioning plates contacting said flexible ribs corresponding thereto and having a slot defined transversely therein for a pin to be movably extended therethrough;

a control member extending through said passage and having a receiving section and a pressing section which extends from said receiving section, said receiving portion extending inclinedly from an axis of said control member and said pressing section extending toward a direction opposite to that of said receiving section corresponding to said axis of said control member, and a cover having two side flanges extending from two opposite sides thereof so as to be slidably received in said grooves of said base portion, said cover having an end cap disposed to an end thereof so as to push the control member extending from said second end of said base portion toward said first end of said base portion wherein said receiving section is moved to a position of said pin when said control member is pushed by said end cap such that said positioning plates are raised toward said cover by said flexible ribs of said resilient elements.

2. The magazine for a staple tacker as claimed in claim 1 wherein said control member has an annular flange extending radially therefrom and a stop having a central hole defined therein is securely positioned to said second end wall of said base portion such that a spring is mounted to said control member and between said annular flange and said stop.

3. The magazine for a staple tacker as claimed in claim 1 wherein each of said resilient elements has two holes defined therein and four protrusions extend from said bottom of said base portion such that said holes of said resilient elements are mounted to said protrusions.

* * * * *